United States Patent [19]

Stargell

[11] 4,116,361

[45] Sep. 26, 1978

[54] FOLDED CAN END PRODUCT

[75] Inventor: Donald E. Stargell, North Canton, Ohio

[73] Assignee: Van Dorn Company, Cleveland, Ohio

[21] Appl. No.: 532,588

[22] Filed: Dec. 13, 1974

Related U.S. Application Data

[62] Division of Ser. No. 299,447, Oct. 20, 1972, Pat. No. 3,871,314.

[51] Int. Cl.[2] ..... B65D 41/32

[52] U.S. Cl. ..... 220/273

[58] Field of Search ..... 220/269-274, 220/90.6; 113/121 C

[56] References Cited

U.S. PATENT DOCUMENTS

| | | | |
|---|---|---|---|
| 842,237 | 1/1907 | Mydland | 220/274 |
| 3,411,661 | 11/1968 | Perry | 220/270 |
| 3,450,301 | 6/1969 | Steck et al. | 220/273 |
| 3,490,643 | 1/1970 | Henning et al. | 220/273 |
| 3,696,961 | 10/1972 | Holk, Jr. | 220/90.6 X |

*Primary Examiner*—George T. Hall
*Attorney, Agent, or Firm*—Frease & Bishop

[57] ABSTRACT

A method of cold drawing, forming and otherwise cold working a sheet metal blank to form a can end member for seaming to one end of a can body in which the can end has a continuous score line along which the can end is severed for complete removal of an end panel, and in which a protective metal fold is formed in the can end with portions of the fold metal extending to a location circumferentially outward beneath and beyond the score line location to present a dull hazard-free edge on the end panel when torn from the can end member. The metal working procedure includes steps of blanking, drawing, panel forming, curling, redrawing, resizing, coining, scoring, out-folding and embossing, by cold working operations performed on a thin sheet metal blank to produce a can end, accompanied by forming an integral rivet to join a pull tab to the end panel portion of the can end. A can end with a continuous annular three layer fold having a continuous annular score line in the top layer. The two lower layers extend radially beneath and beyond the location of the score line. There is a 100° sector of the three layer fold part extending on either side of a center line of a pull tab connected to the can end used to sever the score line which is thicker than the remaining extent of the continuous fold; and the top layer in the sector has a clearance space above the two lower layers.

18 Claims, 27 Drawing Figures

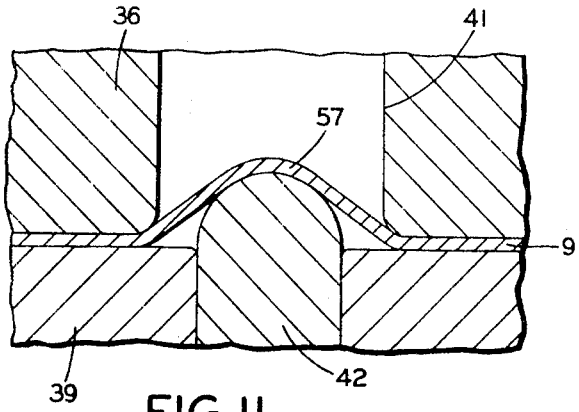
FIG.11
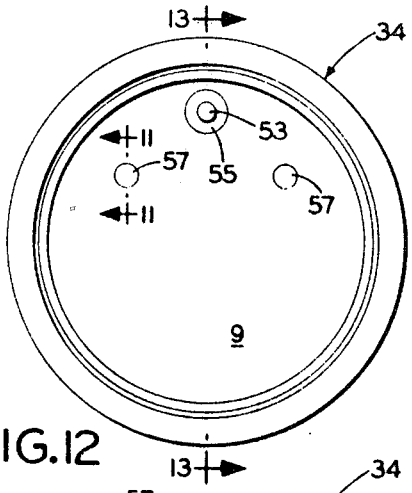
FIG.12
FIG.13
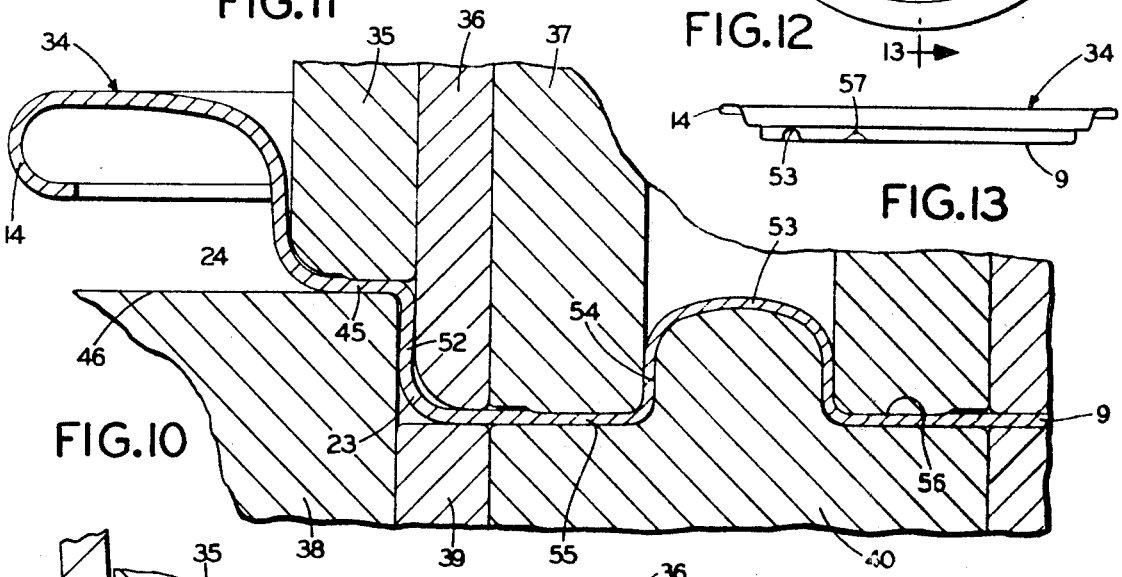
FIG.10
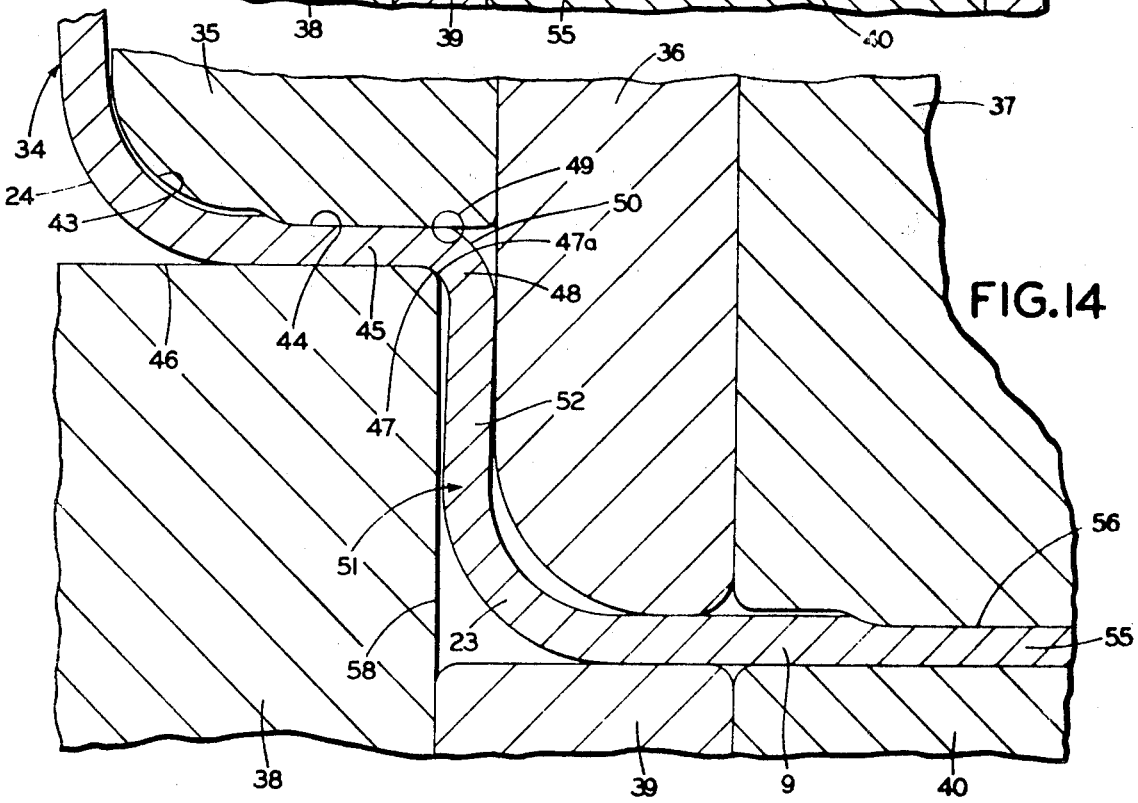
FIG.14

FOLDED CAN END PRODUCT

CROSS REFERENCE TO RELATED APPLICATION

This is a division of application Ser. No. 299,447 filed Oct. 20, 1972 now U.S. Pat. No. 3,871,314.

The can end structure with protective fold is an improvement on the structure shown in copending application of McKernan and Stargell, Ser. No. 229,678, filed Feb. 28, 1972.

BACKGROUND OF THE INVENTION

1. Field of the Invention

The invention relates to a practical and successful procedure for manufacturing sheet metal preferably aluminum, can end structures for food product cans which may be opened easily by tearing a portion of the can end along a score line formed in the end member wherein the cans and can ends may be of the general types shown in Henning et al Pat. No. 3,490,643 and in Bernard J. McKernan application Ser. No. 70,843 filed Sept. 9, 1970, and wherein the can end structures have a hazard-eliminating protective triple metal thickness dull edge fold formation on the end panel removed from the can end structure when torn therefrom.

2. Description of the Prior Art

A number of can designs have been supplied to and used by food packers for packaging small quantities of snack foods such as puddings for children's lunch boxes. These cans have been made of aluminum and have had full opening container ends, the end panels of which are torn out using pull-rings attached to the can end panels.

Problems have been encountered in the use of such cans. Zipping off the lid or removable end panel in the can wall is not always easy for children; all to frequently they cut their fingers on the sharp lid edge or on the rim left inside the can, and the lid almost never comes off without a thick coating of pudding sticking to its underside. The child tempted to lick the lid stands a good chance of cutting his tongue on the sharp edge. The removed lid has been found to be sharp enough to slice a chicken leg.

A report by a school teacher about cut tongues suggested that the can design should be changed to eliminate the hazard, and suggested that this would be easier than attempting to change the natural tendencies of a child to lick pudding sticking to the underside of a removed lid. One trade journal has described the cans as dangerous and has questioned whether the convenience of the cans is worth their hazard.

As a result, food packers that have used such cans have called for a solution to the problem which will eliminate the dangers and hazards.

The can end structure shown in said application Ser. No. 229,678 satisfies this need. However, there have been substantial difficulties encountered in providing for the manufacture of such can end structures. These difficulties involve a number of factors. First, the thinness of and variations in the thickness of the aluminum sheet material, used to permit tearing out of an end panel along a score line, renders cold working operations to form a fold of triple thickness extending annularly around a recessed panel portion in the can end member and with the three layers of the fold extending generally parallel with the plane of the sheet aluminum panel portion extremely difficult to perform without tearing the blank metal, or thinning it to such an extent as to weaken the can end beyond required limits.

Next, the location of the triple fold in a recessed panel, initially drawn in a metal blank, offset from a terminal annular bead flange provided on the can end structure for subsequent seaming at a cannery to a can body, in an annular zone very close to a recessed corner defining the panel recess, and with a continuous generally circular score line located intermediate the fold and corner at a required location with respect to the fold, may promote thinning of the metal in the blank at various stages in the metal working procedures to an unacceptable degree or in an uncontrollable manner.

Further, the formation of a rivet integrally in the blank the riveting thereof to mount a pull ring on the panel portion to be torn from the can end, and the location of the rivet in the can end close to the zone of the can end where the score line is initially ruptured by the pull ring, all add to the complications encountered in attempts to provide practical, satisfactory, successful and readily controlled procedures or series of cold working operations which are repeatable under high speed production conditions to fabricate can end products which meet the required specifications for the stated folded can end structure. In addition, the stiffness of the prior application three layer fold renders the initial severing of the score line difficult in opening the can to remove the panel portion.

These considerations, and the difficulties encountered in attempting to eliminate the complications and to solve the problems that have arisen, thus have presented a need for effective, satisfactory and efficient procedures for the manfacture of folded sheet metal can ends, and for a folded can end in which the folded zone is easy to bend when initially rupturing the score line.

SUMMARY OF THE INVENTION

Objectives of the invention include providing a new procedure or series of cooperatively interrelated metal cold working, forming, drawing, etc. steps or operations for the efficient and successful production of metal can ends with protective metal folds of the character described; providing a new procedure for the manufacture of such metal can ends with protective metal folds which eliminates undesirable thinning of the metal in the blanks at various stages during forming, reforming, working, etc., of the metal and which coins and hardens the metal in predetermined selected areas while avoiding hardening incident to the cold working steps in other areas during successive metal working operations; providing a series of metal working steps for forming the described metal can ends with protective metal folds, which adapt to the thinness of the sheet metal material blanks used to permit tearing out of an end panel along a score line from the end product, without tearing the blank metal during manufacture, and which adapt to the various locations of the triple fold formed, of the score line with respect to the fold, and of the relative location of the score line and fold with respect to the corner which defines the recessed panel in which the fold and score line are located, without promoting an unacceptable degree of metal thinning during the metal working operations carried out; providing a new procedure of interrelated steps for forming a metal can end with protective metal fold, during which procedure a rivet is formed integrally in the blank and riveted to attach a pull ring to the described can end structure, which pull ring subsequently is used for tearing an end panel from the can end structure with a triple fold which defines the torn edge of the panel removed and protects such torn edge from being the source of possible injury; and providing a new procedure for the manufacture of metal can end structures with protective metal folds and providing such can end structures which eliminate difficulties heretofore encountered in the manufacture and use of such products, achieves the indicated objectives simply, effectively and efficiently, and solves problems that have existed in attempting to satisfy the need for a practical and satisfactory procedure for the manufacture of the described folded can ends and for an easily opened can end.

These objectives and advantages are obtained by the discoveries, procedures and methods of making folded can ends, the general nature of which may be stated as including the steps of forming a sheet metal blank to primary cup shape having cup bottom, side and open end flange walls; forming a conical annular band connected with the cup side and bottom walls by curved upper and lower corners; forming the cup open end wall with an outwardly downwardly extending continuous flange; curling the outwardly downwardly extending flange to rounded bead-like formation; then drawing the blank to reform metal in the conical annular band to provide a rounded shoulder having upper convex and lower concave surfaces in cross section intermediate the upper and lower corners connected with the upper corner by an annular horizontal portion extending inward from said upper corner and connected with the lower corner by a downwardly inwardly tapered band portion; then resizing the redrawn blank and coining the metal in an annular zone of said horizontally extending portion located inward of said upper corner and at the same time outwardly bulging the tapered band between said shoulder and lower corner, simultaneously during said resizing step decreasing the curvature of the lower concave surface of said shoulder to form a fold pivot point, forming the inner annular edge of the coined horizontal upper surface portion to define a break point located radially inward of the outer surface of the outward bulge; then scoring the coined metal in said annular horizontal zone to form an annular scored tear line on the coined upper surface located radially outward of said break and pivot points, and simultaneously during said scoring step further outwardly bulging the resized blank between the shoulder and lower corner; then folding the metal between the shoulder and lower corner to form a continuous annular triple layer fold generally S-shaped in cross section continuously around the blank with the annular score line in the coined metal located in the upper fold layer and above the two lower fold layers; during said redrawing, resizing, coining and scoring steps forming a rivet bubble in the cup bottom wall adjacent the location of the triple fold, coining metal in the cup bottom wall around the rivet bubble, and scoring a bend line in the coined area around the rivet bubble and between the bubble and fold location; then assembling a pull ring to the rivet bubble, locating the pull ring in predetermined position, and staking the rivet bubble metal against the pull ring; then stamping indicia on the bottom wall and probing the assembled blank to detect the presence or improper location of the pull ring; carrying out the successive described steps as cold working operations; sharpening the radius of curvature of the pivot point during its formation; reducing the distance from the shoulder to the cup bottom wall during successive cold working operations; and reducing the radius of curvature of the lower corner during successive cold working operations.

Summarizing, the new concept provides a method of cold working a sheet metal blank to form a can end member having a recessed end panel extending from a recessed corner and connected with the corner by an annularly scored protective metal triple fold by a series of successive drawing, redrawing, resizing, scoring and folding operations in which said successive operations include forming an annular fold panel extending between an upper curved corner formed in the side wall of a cup drawn from a metal blank and a lower curved corner connected with the cup bottom wall; forming an annular upwardly inwardly convex shoulder in the fold panel between the upper and lower corners; successively bulging the cup wall portion circumferentially outward between the shoulder and lower corner; successively decreasing the depth of the cup bottom wall below the shoulder; and successively decreasing the radius of curvature of the lower corner in preparation for folding the metal between the shoulder and lower corner to form an annular triple fold S-shaped in cross section.

The objectives also are obtained by the new can end which has a three layer fold with a substantial sector thereof, preferably about 100°, with portions extending on either side of the center line of a pull tab secured to the can end and used to sever a panel portion on a continuous score line formed at a location in the upper fold layer overlying the two fold layers below; and with the thickness of the sector being greater than that of the remainder of the continuous fold. The upper layer of the fold in the sector is spaced above or has a clearance above the other two fold layers below; so that the upper layer is easily bent inside the score line prior to bending the remaining fold layers in initiating rupture of the can end along the score line by pull tab movement.

BRIEF DESCRIPTION OF THE DRAWINGS

Preferred methods, steps, operations, procedures and products constituting preferred embodiments of the invention — illustrative of the best mode in which applicant has contemplated applying the principles — are set forth in the following description and shown in the drawings and are particularly and distinctly pointed out and set forth in the appended claims.

FIG. 10 is a view similar to FIG. 8 illustrating the further step of redrawing the rivet bubble;

FIG. 11 is a view similar to FIG. 9, illustrating the redrawing of the tab positioning dimple, looking in the direction of the arrows 11—11, FIG. 12;

FIG. 12 is a view similar to FIGS. 1 and 6 illustrating the redrawn stage blank produced by the operations illustrated in FIGS. 10 and 11;

FIG. 13 is a view of the stage blank illustrated in FIG. 12, looking in the direction of the arrows 13—13, FIG. 12;

FIG. 14 is a further substantially enlarged fragmentary view of a portion of FIG. 10;

Similar numerals refer to similar parts throughout the drawings.

DESCRIPTION OF THE PREFERRED EMBODIMENT

Figure 3:
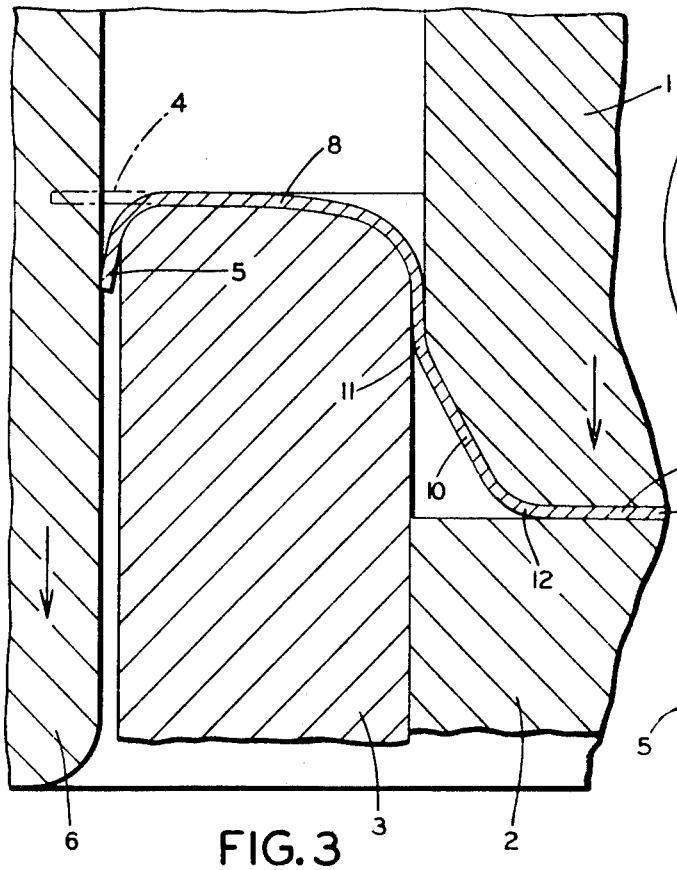
FIG. 3 is a greatly enlarged fragmentary sectional view of a corner of the drawn stage blank shown in FIG. 2, illustrating the dies used in the drawing and flange forming stages of the blanking operation.

The new method is illustrated in the drawings for the manufacture of a can end member or structure for a typical small-sized can, such as shown in said copending application Ser. No. 229,678. However, the new method is not limited to the manufacture of the particular size of can end illustrated, because the can end may be of any desired size for use or assembly with can bodies of various sizes, shapes, or capacities, or of any one of a number of types made by various manufacturers, and which can ends have a continuous score line in the can end wall adjacent the double seam between the can body and end wall. For example, cans and can ends of such various sizes are shown in U.S. Pat. Nos. 3,490,643 and 3,682,350.

The can ends may be made of very thin gauge aluminum sheet material. Such material, for example, may have a thickness of 0.010 inch. As received from the aluminum sheet material in sheets or coiled strip, the material may have gauge variations of plus or minus 0.0005 inch. Material this thin and with the indicated gauge variations presents problems of avoiding tearing or undue thinning when subjected to a number of successive cold forming or working operations which are necessary to produce a can end structure such as shown in said copending application Ser. No. 229,678 with a protective fold.

I have discovered a series of interrelated operations and related controls which may be used to avoid difficulties that have been encountered in attempting to solve the complex problem that has existed. This series of operations or steps and critical features thereof and controls exercised are set forth in detail under appropriate headings below.

Blanking Operation

Figure 1:
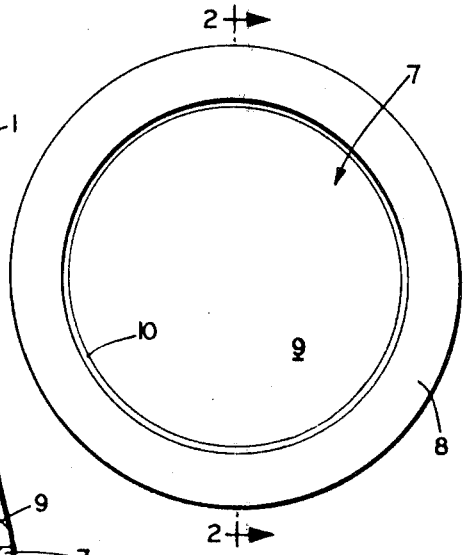
FIG. 1 is a top plan view of a stage blank produced by a first blanking or drawing operation performed on a sheet metal starting blank.
Figure 2:
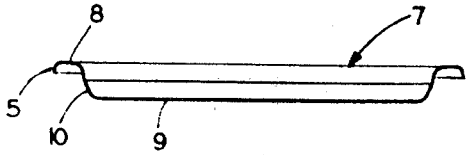
FIG. 2 is a diagrammatic cross-sectional view looking in the direction of arrows 2—2, FIG. 1.

A starting blank of aluminum sheet material of the gauge described is drawn in dies illustrated in FIG. 3, including a punch 1 and die cavity forming members 2 and 3, in a blanking press. Initially the blank as it is being drawn has an outwardly directed terminal flange portion indicated in dot-dash lines at 4, but the portion 4 is drawn downward at 5 by the secondary punch 6 at the end of the blanking operation, thus producing the drawn stage blank 7 (FIGS. 1 and 2).

Blank 7 has a rim 8 inverted channel-shaped in cross section, which later provides for seaming the can end to one end of a can body. Blank 7 also has a recessed wall 9. The wall 9 is connected with the rim 8 by a conically-shaped annular band 10. The annular and angular shape in cross section of band 10, and the width or extent thereof between curved corners 11 and 12 are important aspects of the blanking operation interrelated with subsequent operations. The band 10 between corners 11 and 12 provides what may be called the "fold-panel" in the drawn stage blank 7. The angular or conical shape of the band or fold panel 10 is provided to control metal thinning during sugsequent operations which finally culminate in folding metal originating in the fold panel 10.

Curling Operation

Figure 5:
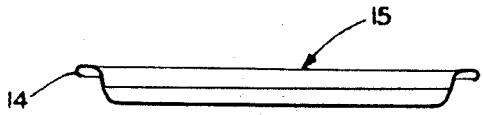
FIG. 5 is a view similar to FIG. 2 showing the curled stage blank with a curled or beaded flange produced by the curling operation of FIG. 4.
Figure 4:
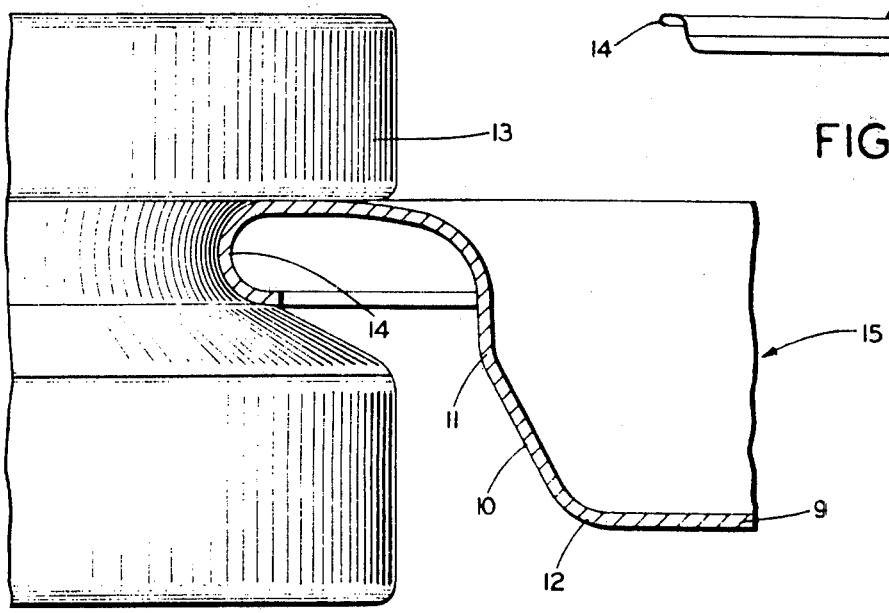
FIG. 4 is a diagrammatic view illustrating the next curling operation performed on the flange of the drawn stage blank shown in FIG. 2.

The next operation is shown in FIG. 4. The drawn stage blank 7 is rolled between usual curling rolls 13 in a known manner to provide a rounded bead-like formation 14 in the downturned flange 5 of blank 7. This curling operation produces a typical bead 14 in the curled stage bank 15 indicated in FIGS. 4 and 5.

Redraw Operation

Figure 9:
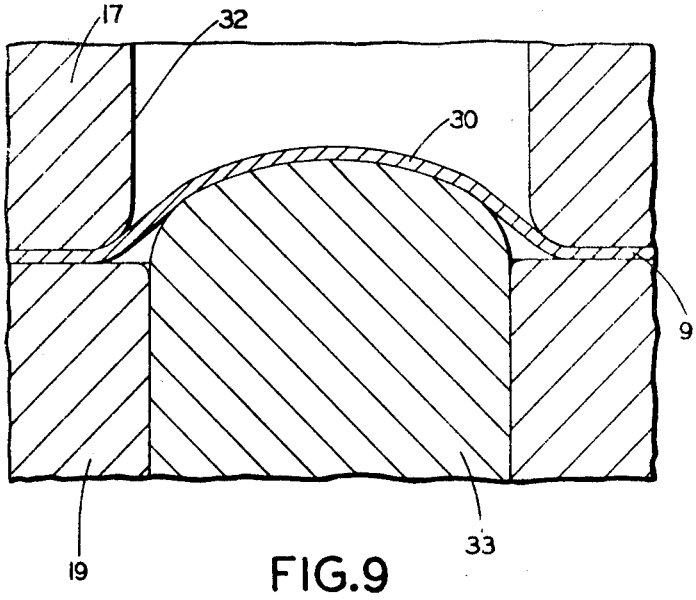
FIG. 9 is a fragmentary view similar and on the same scale as FIG. 8, illustrating the initial stage of drawing tab positioning dimples, looking in the direction of the arrows 9—9, FIG. 6.
Figure 8:
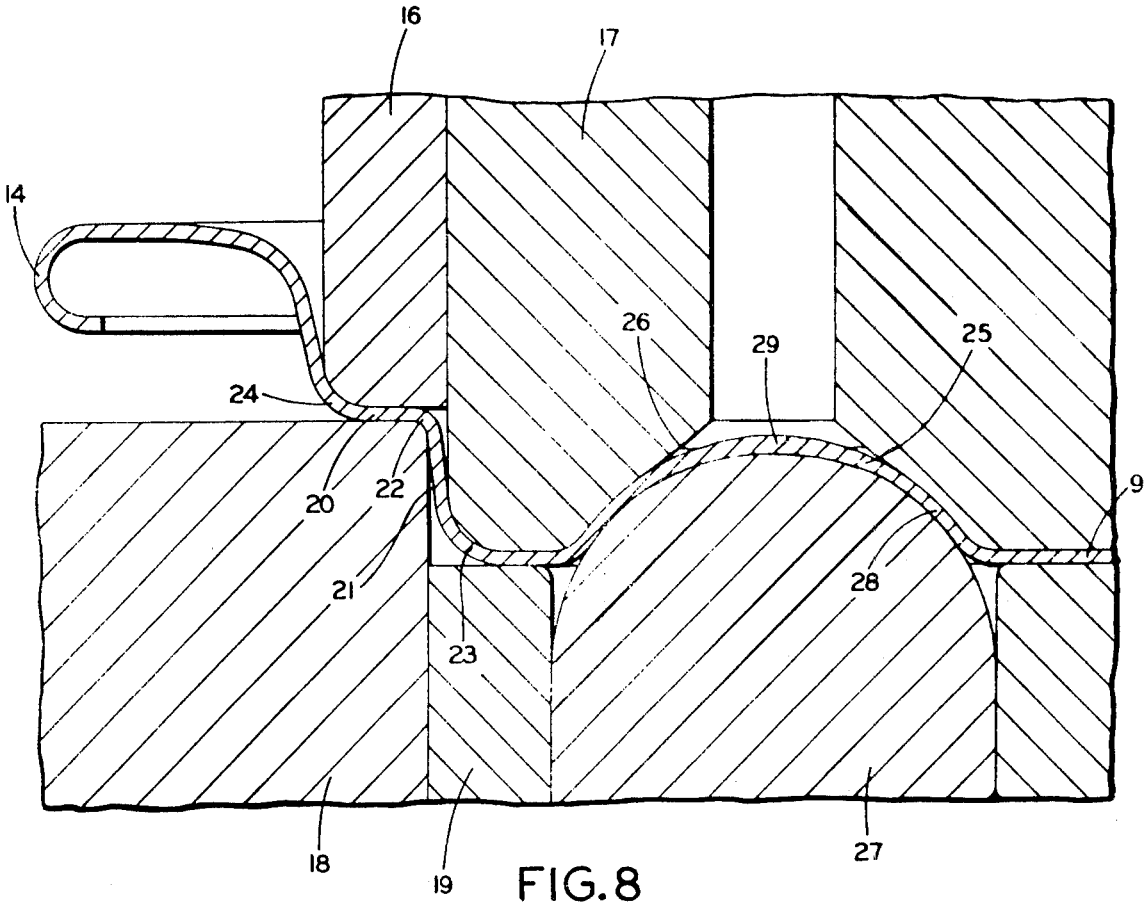
FIG. 8 is a fragmentary view similar to and on the same scale as FIG. 3 of a greatly enlarged portion of the redrawn stage blank of FIG. 7 and the dies used for the redraw operation, and also illustrating the initial formation of the rivet bubble, the section also being on the line 7—7, FIG. 6.

In the next operation, the curled stage blank 15 is redrawn in dies illustrated in FIGS. 8 and 9. This redraw operation reforms the fold panel or band 10 of FIGS. 3 and 4 to the shape illustrated in FIG. 8. The redraw dies illustrated in FIG. 8 include relatively movable upper punch members 16 and 17 and die cavity forming members 18 and 19. Initially, during the redraw operation, punch 16 and die member 18 reform a portion of the upper end of band 10 horizontally, as indicated at 20. The remainder of the annular band 10 is reformed at 21, slightly downwardly inwardly tapered, as shown, from a rounded shoulder 22 to the curved corner 23, reformed from curved corner 12 of curled stage blank 15.

The horizontal annular wall portion 20 extends annularly between recessed shoulder 24, and the rounded convex shoulder 22. The recessed shoulder 24 is curved and originates from the curved corner 11 illustrated in FIG. 3.

Generally, the metal in the blank portions 20, 21, 22 and 23 is not thinned during the redraw operation because its movement during reforming is inward toward the center of the blank 15 which is the starting blank for the redraw operation.

Figure 6:
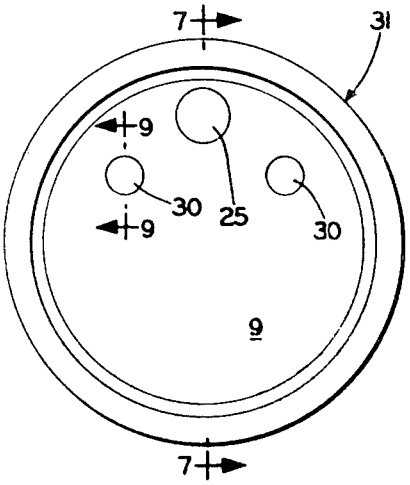
FIG. 6 is a view similar to FIG. 1 illustrating the redrawn stage blank produced by redrawing the blank of FIG. 5.
Figure 7:
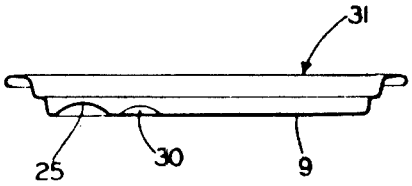
FIG. 7 is a section looking in the direction of the arrows 7—7, FIG. 6.

During the redraw operation, a rivet bubble 25 is drawn upwardly in the recessed wall 9 of the curled stage blank 15, as shown in FIGS. 6, 7 and 8. This bubble 25 is formed by the cooperative action of the die cavity formation 26 in upper punch member 17 and the rounded nose at the upper end of rivet punch 27. The wall of bubble 25 is pinched slightly at 28 between rivet punch 27 and die cavity 26. This slightly thins the metal in the pinched zone 28 during bubble formation to provide the necessary flow of metal into the top 29 of the bubble 25 to prevent undue thinning of the metal in the zone 29 where a rivet head ultimately will be formed.

Also during the redraw operation, tab positioning dimple bubbles 30 are drawn in the recessed wall 9 on opposite sides of a diameter of the redrawn stage blank 31 (FIG. 6) which passes through the center of the rivet bubble 25, as indicated for example, by the section line 7—7 in FIG. 6. The upper punch member 17 is formed with openings 32 to permit the dimple bubbles 30 to be drawn upward therein by locator punches 33 movable in the lower die cavity member 19.

One of the important aspects of the invention is the formation of the relatively sharp rounded shoulder 22 connecting the horizontal portion 20 of the reformed band 10 with the reformed tapered band portion 21. The radius of the underside of the rounded shoulder 22 in cross section, should approximate 0.005 inch or approximately one-half the gauge of the metal in the starting blank aluminum sheet material. It is important, as will be explained below, to form this curved shoulder as sharply as possible during the redraw operation without tearing, breaking, thinning or work hardening the metal in the shoulder zone as a result of the redraw operation.

It is indicated below that in a subsequent operation, the radius of the underside of shoulder 22 in cross section should be reduced to a radius smaller than 0.005 inch when further reformed. It is important in the redraw operation (FIG. 8) to form the radius 22 before reforming as closely as possible to the ultimate reduced reformed radius required to be formed in the subsequent operation.

Another important aspect of the redraw operation is the clearance provided, as illustrated in FIG. 8, between the inner and outer surfaces of the reformed tapered band portion 21 so as to reduce work hardening of the metal in this zone to a minimum. The depth of the recessed wall 9 below curled flange 14 in the redrawn stage blank 31 is not materially changed from such depth in curled stage blank 15.

One of the other matters of importance in the redraw and rivet bubble forming operation shown in FIG. 8 is the relative locations of the rivet bubble 25, the rounded shoulder 22 and the recessed shoulder 24. It is desirable for many reasons to locate the center of the rivet bubble 25 as possible to the rounded shoulder 22 and to locate the rounded shoulder 22 as close as possible to the recessed shoulder 24. However, this relationship must be achieved without either unduly thinning or unduly work hardening the metal in the regions of these related elements during the redraw operation.

Resize and Rivet Redraw Operation

In the next operation, certain portions of the redrawn stage blank 31 are resized, and the rivet and dimple bubbles 25 and 30 are redrawn in final form. This metal working is shown in FIGS. 10, 11 and 14, and the resized stage blank 34 resulting therefrom is shown in FIGS. 12 and 13.

The dies for the resizing operation illustrated in FIGS. 10, 11 and 14 include relatively movable upper punch members 35 and 36 and an upper rivet reforming die 37 movable in upper punch 36, and lower die cavity forming members 38 and 39 and rivet reforming punch 40. The upper punch 36 (FIG. 11) also is formed with openings 41 cooperatively arranged with the lower dimple punches 42 movable in lower die cavity member 39 for reforming the dimple bubbles 30.

Special punch and die formations are provided in the tools for the resize and rivet redraw operation, best illustrated in FIG. 14. The annular nose of upper punch member 35 is relieved at its outer annular corner 43. The nose has a flat projecting annular coining surface 44 which thins and coins the metal in the zone 45 of the blank against the upper surface 46 of the lower die member 38. The annular corner 47 of lower die cavity member 38 has a fillet radius of 0.002 inch. This radius is reduced from the fillet radius of the die member 18 in FIG. 8 which formed the 0.005 inch inside corner fillet radius for the rounded shoulder 22 of redrawn stage blank 31. The sharp corner radius 47 in die member 38 imparts a corresponding shape at **47*a* to the undersurface of the rounded shoulder 48 in the resized stage blank 34**.

The coining of the metal in the coined zone 45 thins the metal and the metal flows slightly inward toward the center of the resized blank 34 so that the point, indicated by the circle 49, herein called a "break point", where the annular coining surface 44 of the nose of upper punch 35 intersects with the outer rounded surface 50 of the rounded shoulder 48 of resized blank 34, is located radially inward of the sharp radius zone **47*a*** of the blank, herein called "blank pivot point".

During this resizing or coining operation of the coined zone 45, the recessed depth of the recessed wall 9 of the resized blank 34 (FIG. 10) below the coined zone 45 (0.082 inch) is reduced by preferably approximately 0.010 inch from the similar recessed depth of the recessed wall 9 of redrawn blank 31 (0.093 inch) below the horizontal portion 20 of the blank (FIG. 8). At the same time that the recessed depth of wall 9 is reduced, the curvature of corner 23 is reduced from a radius of 0.038 inch in FIG. 8 to a radius of 0.028 inch in FIG. 10.

This reduction in recess depth, along with the coining of the coined zone 45 in recessed blank 34, as well as the clearance illustrated between upper punch member 36 and lower die member 38, results in forming a slight prebulge indicated at 51 in the annular wall portion 52 of the resized blank 34. The prebulge extends between the rounded shoulder 48 and the curved corner 23 of the blank.

At the same time that the coining and prebulging is occurring, the rivet reforming punch 40 and upper rivet die 37 reform the rivet bubble 25 of redrawn stage blank 31 to the final rivet shape shown in FIG. 10 wherein the rivet bubble 53 has a substantially cylindrical wall 54 connecting the bubble 53 with the recessed wall 9 of the blank 34.

During reforming of the rivet, the metal surrounding the rivet annularly around the cylindrical wall 54 is coined at 55 by the nose formation 56 on rivet die 37.

Also during the blank resizing and rivet reforming or redraw operation, the dimple bubbles 30 of the redrawn stage blank 31 are reformed as shown in FIG. 11 to the reformed dimple shape indicated at 57 between the upper punch member dimple opening 41 and the dimple punch 42.

An important feature of the resize and rivet redraw operation is the formation of the slight prebulge 51 in the annular wall 52 of the resized stage blank 34. The prebulge is provided in this operation to facilitate the folding and formation of a fold in a subsequent operation. As previously indicated, the prebulging results from the reduction in the height of the blank from the coined zone 45 to the recessed wall 9, as well as from the coining of the coined zone 45 to reduce the size of the inside radius formation of the rounded shoulder 48.

The clearance illustrated between the recessed blank shoulder 24 and the outer annular corner 43 of the upper punch member 35 prevent any metal working during the operation of the metal in the recessed shoulder 24 which subsequently becomes the chuck radius for receiving the chuck of a seaming tool by which the curled flange 14 of the blank is seamed to a can body. The upper surface of the coined zone 45 of the blank, as shown, is located inside the chuck radius 24 and may be termed a "chuck face" of the blank.

Furthermore, the coining of coined zone 45 assists in sharpening the pivot point **47*a* formed by the sharp annular corner 47 and locates the break point 49 inside the diameter of the opening 58 in die 38 which forms the inner extremity of the rounded shape 47*a* formed in the blank by the 0.002 inch radius corner 47 so that the break point 49 is inside of the pivot point 47*a*** on which the metal ultimately is folded.

Scoring Operation

Figure 18:
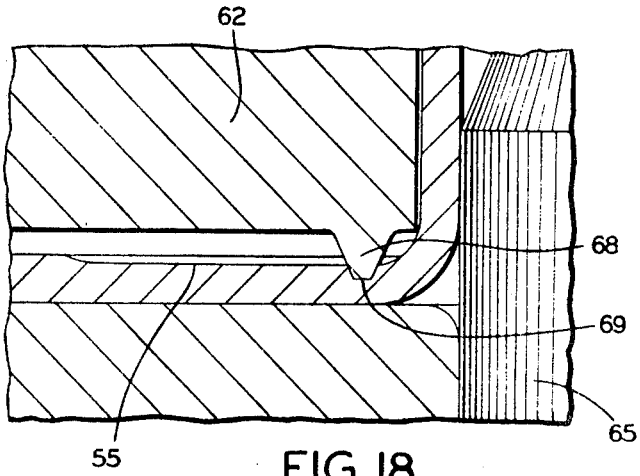
FIG. 18 is a view on an enlarged scale similar to FIG. 17 of another portion of FIG. 16, showing the bend line score adjacent the rivet bubble.
Figure 15:
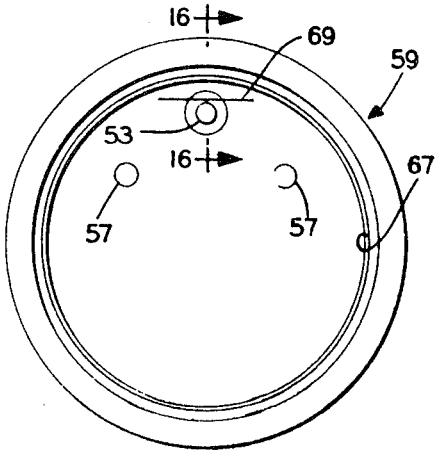
FIG. 15 is a view similar to FIG. 12 showing the stage blank after scoring.
Figure 17:
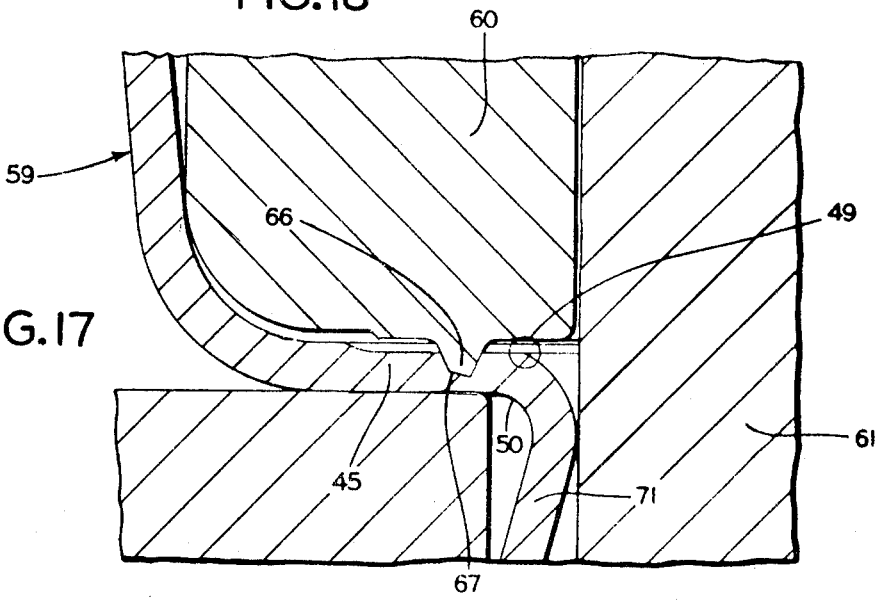
FIG. 17 is an enlarged view, similar to FIG. 14, of a portion of FIG. 16 illustrating the scoring step to produce the tear line score.
Figure 16:
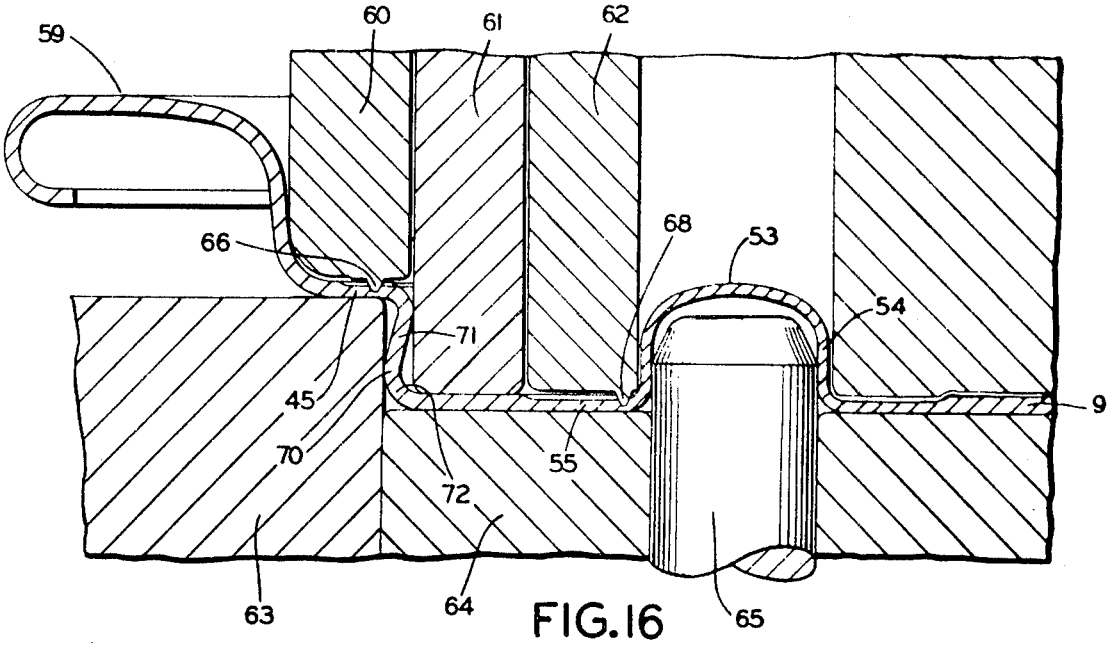
FIG. 16 is an enlarged fragmentary section view similar to FIG. 10 illustrating the scoring operation and the scoring dies, looking in the direction of the arrows 16—16, FIG. 15, with the stage blank of FIG. 15 in the dies.

In the next operation illustrated in FIGS. 16, 17 and 18, certain portions of the resized stage blank 34 are scored to provide the scored stage blank 59 (FIG. 15).

The dies for the scoring operation illustrated in FIGS. 16 to 18, include relatively movable upper punch member 60, 61 and 62, die cavity forming members 63 and 64, and rivet pilot and locator pin 65.

In carrying out the scoring operation, the main upper punch member 61 which is spring loaded, bottoms on the resized stage blank 34 inserted between the punch, and the die cavity members 63 and 64 and properly located therein by the rivet pilot pin 65. Thereafter, the scoring punches 60 and 62 move home. The score blade 66 on the nose of upper punch member 60 for forming the continuous score line 67 where the panel of the can end is torn from the container subsequently when opening the container, is shown in FIG. 17. The score blade 68 on upper punch member 62 forming a fold line score 69 adjacent the rivet bubble 53 on which the initially ruptured portion of the end panel to be removed, bends when tearing the panel from the can end, is shown in FIG. 18.

The score blades 66 and 68 score the coined portions 45 and 55, respectively, of the resized stage block 34 in carrying out the scoring operation, as shown in FIGS. 16 to 18. Tear out score line 67 preferably is deeper, as shown in FIG. 17, than the fold line score line 69 as shown in FIG. 18. Furthermore, the score line 66 in cross section is angularly shaped, rather than the symmetrical shape of the score line 69. This angular shape of the score line 67 controls the location of the tear along the score to protect the edge of the torn panel as described in application Ser. No. 229,678.

The depth of the scoring operation die cavity (FIG. 16) formed by lower die cavity members 63 and 64 is less than the depth of the die cavity (FIG. 13) for the resize and rivet redraw operation (FIG. 10). Thus, the height of the recess of resized stage blank 34 when placed in the die cavity shown in FIG. 16, is greater than the die cavity; so that a greater prebulge 70 is formed in the annular wall 71 of scored stage blank 59 as the scoring dies move home. This greater prebulge reduces the radius of the curved corner 23 of the recessed wall 9 in the resized stage blank 34 to subsequently one-half in the resulting radius of the curved corner 72 in the scored stage blank 59.

Preferably, the radius at the corner 23 in FIG. 10 is 0.028 inch while the radius of curved corner 72 in scored stage blank 59 is preferably 0.015 inch.

The annular space in the scoring operation dies (FIG. 16) between the outer cylindrical surface of the telescoped upper punch member 61 and the inner cylindrical surface (2.227 inch diameter) of the lower die cavity member 63 is radially wider than the corresponding annular space (2.220 inch diameter of cavity in member 38) in the dies for the resizing and rivet redraw operation (FIG. 10). This enlarged scoring die annular space permits the increased prebulge 70 of the annular bulged wall 71 of scored stage blank 59 to occur, as shown.

At the same time, the break point 49 and the pivot point 50 in the scored stage blank 59 (FIGS. 16–17) each are located substantially radially inside of the location of the outer surface of the prebulge 70 in annular bulged wall 71.

Folding Operation

Figure 21:
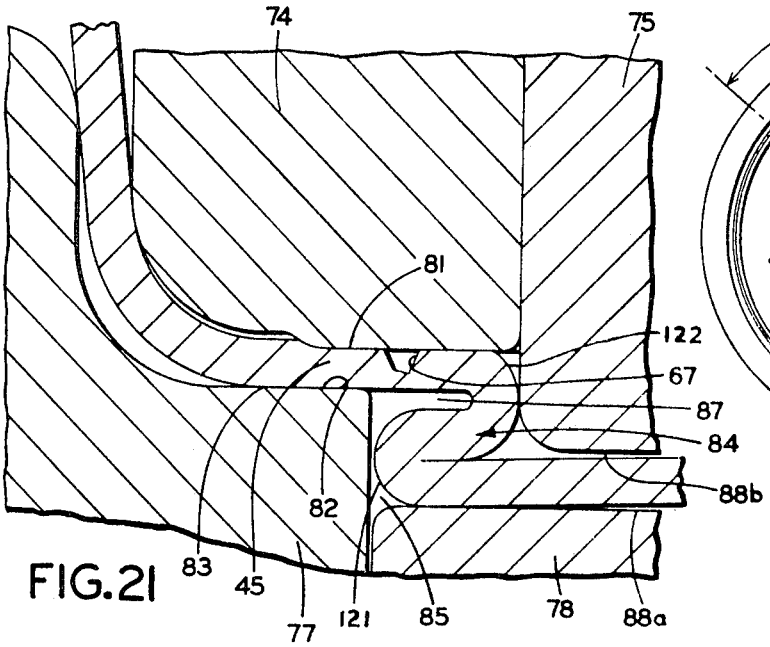
FIG. 21 is an enlarged view of a portion of FIG. 19, showing the fold formation adjacent the rivet bubble.
Figure 20:
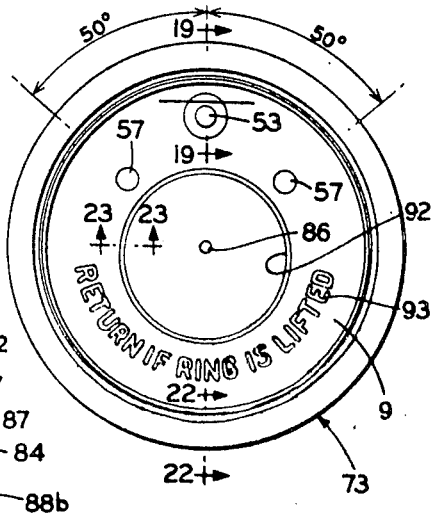
FIG. 20 is a view similar to FIG. 15 of the folded stage blank.
Figure 19:
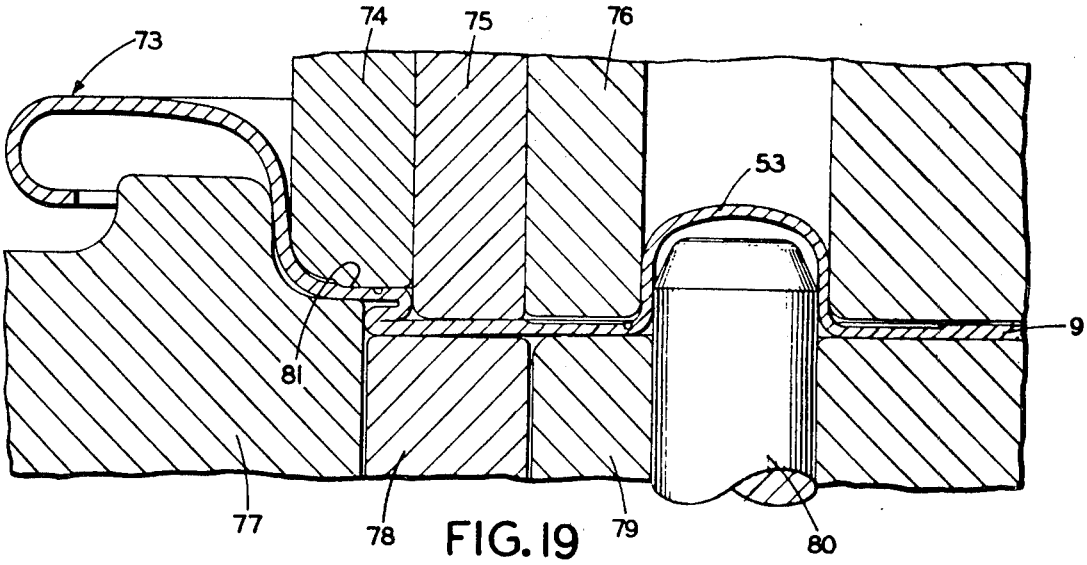
FIG. 19 is a view similar to FIG. 16 illustrating the folding operation, looking in the direction of the arrows 19—19, FIG. 20, and showing the new product characteristics.

The next operation illustrated in FIGS. 19 to 21 folds metal in the scored stage blank 59 to form the folded stage blank 73 (FIG. 20).

Figure 22:
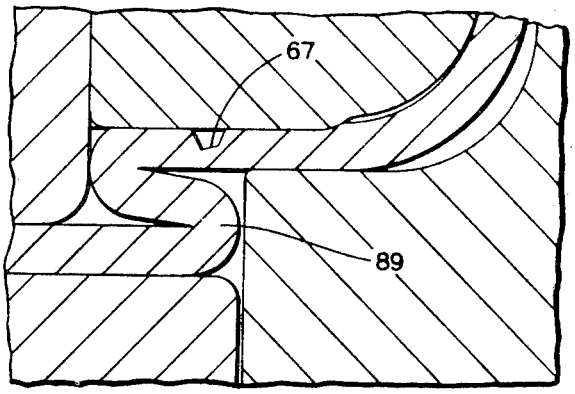
FIG. 22 is an enlarged view similar to FIG. 21 but showing the fold formation at 180° from the location of FIG. 21 looking in the direction of arrows 22—22, FIG. 20.

The dies for the folding operation illustrated in FIGS. 19, 21 and 22, include relatively movable upper punch members 74, 75 and 76, die cavity forming members 77, 78 and 79, and rivet pilot and locator pin 80.

In carrying out the folding operation, a scored stage blank 59 is entered in the die cavity formed by members 77, 78 and 79, located in proper position by locator pin 80. Upper punch member 75, which is spring pressed, first moves downward to clamp recessed wall 9 against the upper surface of die cavity member 78. Meanwhile, upper punch member 76 telescopes over the rivet bubble 53 locating stage blank 59 in proper position with respect to the punch and die members cooperatively with the rivet locating pin 80. At the same time, outer upper punch member 74 moves downward and its nose formation 81 engages the coined zone 45 which has been scored at 67, and pushes the coined zone 45 downward into the die cavity until the undersurface 82 of the coined zone 45 bottoms on the upper annular surface 83 of the die cavity member 77 (FIG. 21).

During the described motion of upper punch member 74, the prebulged portion 70 of annular bulged wall 71 of stage blank 59 continues to bulge outwardly and folds generally in S-shape to form the triple fold indicated generally at 84 in FIG. 21. The die cavity 85 in which the triple fold 84 is formed (FIG. 21) has a greater depth throughout an arc of 50° at either side of a diameter passing through the center of the rivet 53 and the center 86 of folded stage blank 73 (FIG. 20) than the metal thickness of the three folds. This produces a fold clearance 87 between the top and middle fold layers throughout the 100° arc. The die clearances between members 75 and 78 and the recessed wall 9 permitting thick thickened fold throughout the 100° arc are indicated at 88*a* and 88*b* in FIG. 21. The fold 89 formed throughout the remaining 260° of the fold formation differs, as shown in FIG. 22 (which is the section taken on the line 22—22, FIG. 20 at 180° from the section line 19 where the sectional views of FIGS. 19 and 21 are taken) from the formation of the fold 84 with its fold clearance 87.

In FIG. 22, the triple fold 89 is not as thick as the triple fold 84 of FIG. 21, being only slightly greater than the thickness of the three layers of the fold, because the die clearances 88*a* and 88*b* of FIG. 21 are not present in the 260° arcuate portion of the dies extending from either end of the 100° arcuate portion of the dies wherein the triple fold shape 84 is formed.

As indicated, this 100° arc thickened triple fold zone 84 is located outward of the rivet bubble 53 and extends along the fold from either side of the rivet bubble 53 to allow the top layer of the triple fold, in which the score line 67 is contained, to flex slightly at the time when a pull ring secured to the rivet later is moved to initiate fracturing the can end along the score line 67.

Figure 23:
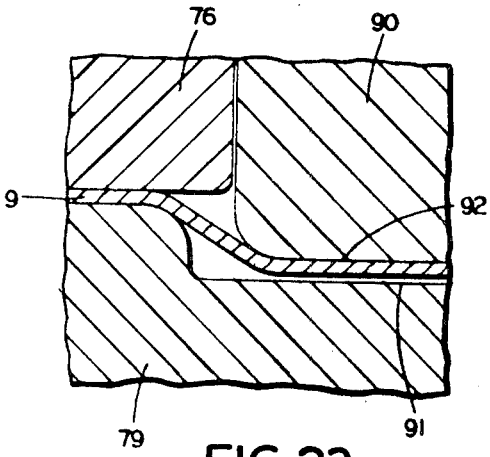
FIG. 23 is a fragmentary section illustrating the dies used to form the thumb clearnace panel shown in FIG. 20, taken on the line 23—23, FIG. 20.

The dies used for the folding operation also preferably include an upper punch member 90 (FIG. 23) movable in the central region of the upper punch member 76, and a cavity formation 91 below punch 90 in die cavity member 79. The punch 90 and die cavity 91 form a thumb indentation 92 in the center of the recessed wall 9 of folded stage blank 73.

Where a message is to be embossed in a can end, as indicated at 93, embossing formations may be incorporated in the punch and die members 76 and 79.

Tab Assembly and Rivet Staking Operation

Figure 25:
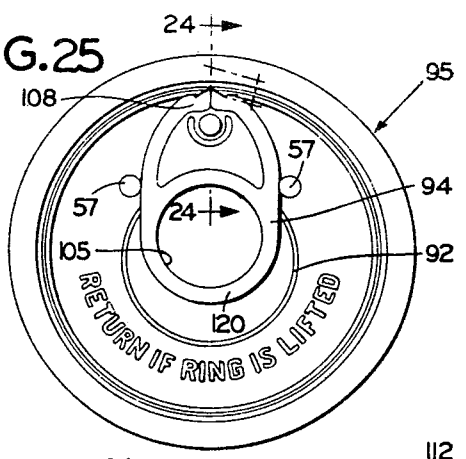
FIG. 25 is a view similar to FIG. 20 illustrating the pull tab assembled to the can end.
Figure 24:
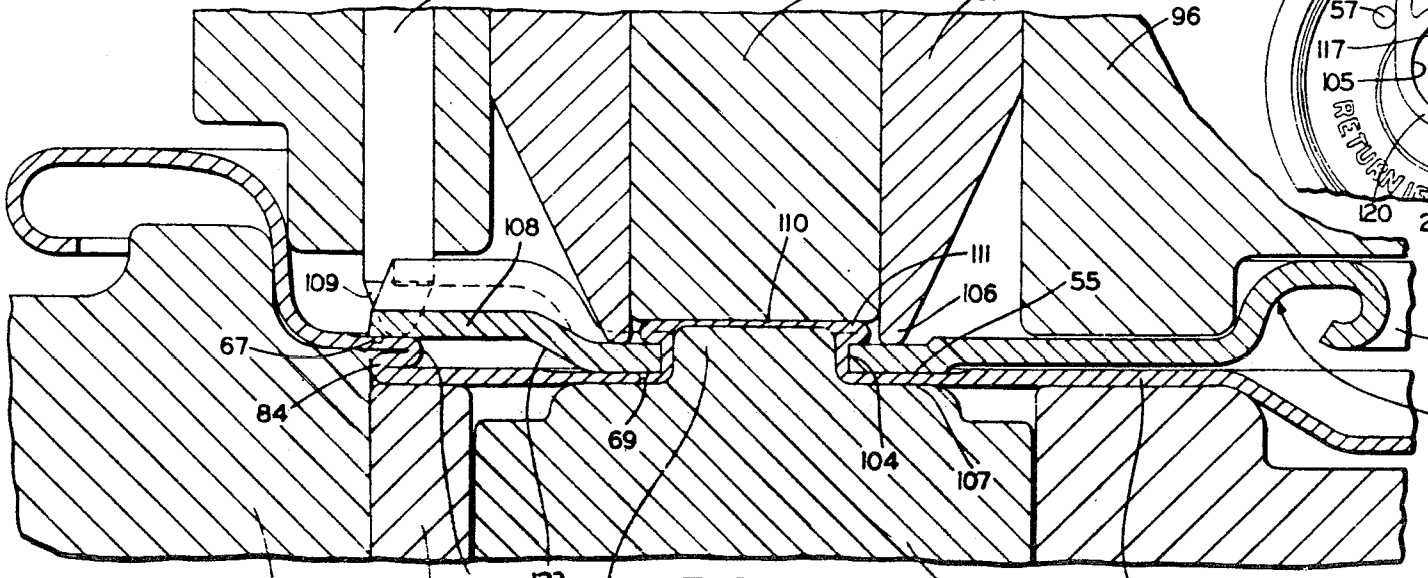
FIG. 24 is a view similar to FIG. 19 illustrating the assembly of a pull tab on the folded can end, and the staking of the reivet to secure the pull tab, looking in the direction of the arrows 24—24, FIG. 25, and showing the new product.

The next operation illustrated in FIG. 24 involves the assembly of a pull ring tab 94 to the folded stage blank 73, to produce the assembled can end 95 shown in FIG. 25.

The dies for assembling a pull ring tab 94 with the folded stage blank 73, and for staking the rivet 53 to secure the tab 94 to the can end shown in FIG. 24, include punch members 96, 97 and 98, tab locator members 99 and die cavity members 100 and 101 and lower staking punch 102.

In carrying out the tab assembly and rivet staking operation, a folded stage blank 73 is placed in the die cavity formed by members 100, 101 and 102 with punch nose 103 of lower staking punch 102 telescoped in the rivet bubble 53 of blank 73.

A rivet opening 104 in a pull tab 94 is slipped over the rivet bubble 53. The pull tab 94 when thus assembled on folded stage blank 73 (FIG. 25) has its side edges engaged with the reformed dimples 57. These dimples 57 thus serve as tab positioning dimples to locate the axis of the tab 94, passing through the center of the pull ring finger opening 105 and the center of the tab rivet opening 104, radially of the assembled can end 95.

Upper punch member 96 then moves downward to the position shown in FIG. 24 and spring loaded punch 97 moves home so that its annular ring-like nose 106 clamps the tab 94 against the coined area 55 of the blank 73 surrounding the rivet bubble 53. The undersurface of coined area 55 is seated on the annular face 017 of lower staking punch 102.

Meanwhile, tab locators 99 press downward and bottom on on the triple fold 84 at either side of the nose 108 of tab 94 to control the location of the pull tab 94. Tab locators 99 each have tapered noses 109 which will engage the sides of the pull tab nose 108 and straighten the pull tab to correct position in the even that it has rotated out of position on the rivet bubble 53.

While the folded stage blank 73 and pull tab 94 are thus positioned and held in the tab assembly and staking operation dies, the upper riveting punch 98 moves downward within tubular punch 97 and bottoms against the punch nose 103 of lower staking punch 102, as shown in FIG. 24. This riveting and staking operation reforms the rivet bubble 53 to the shape shown in FIG. 24 wherein the center portion of the rivet head is thinned and coined at 110, and an outturned rivet head fold flange 111 is formed annularly around and overlapping the pull tab 94 at its rivet opening 104.

Stamp and Tab Check Operation

Figure 27:
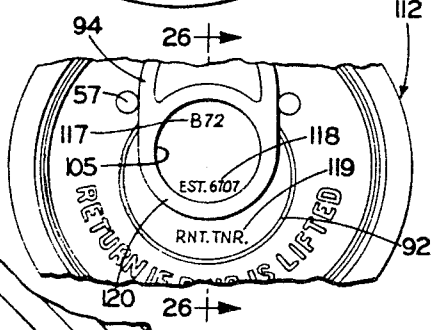
FIG. 27 is a fragmentary view similar to a portion of FIG. 25 illustrating the final folded can end produced by the operations illustrated.
Figure 26:
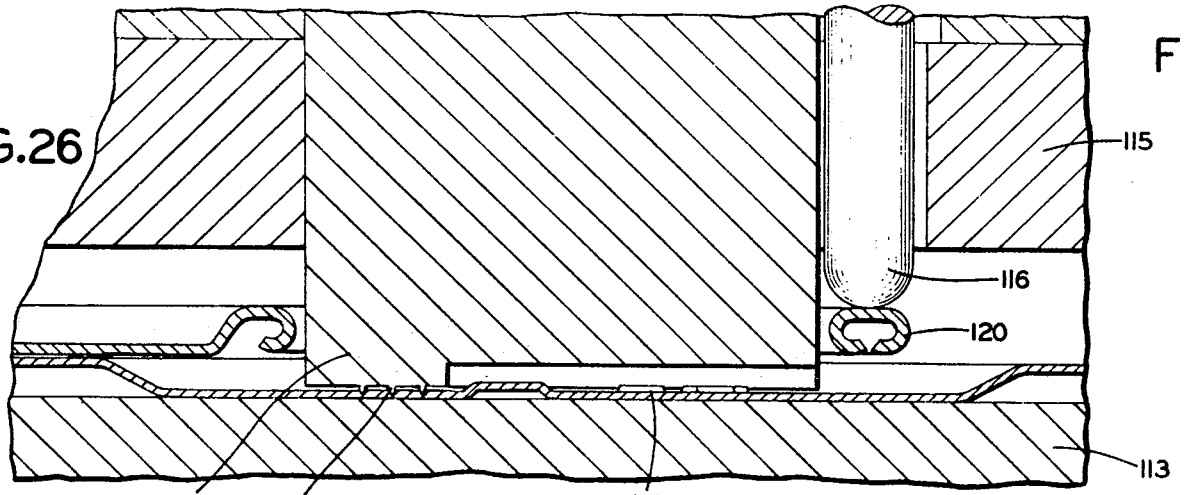
FIG. 26 is a view similar to FIG. 24 illustrating a final operation of code stamping and detecting a missing or misaligned pull tab, taken on the line 26—26, FIG. 27.

The final operation in the manufacture of the described folded can end is illustrated in FIG. 26 and involves the stamping of desired indicia on the can end and checking the assembled can end 95 to determine whether the tab 94 is missing or has rotated to an improper position. This final stamp and tab check operation produces the final folded can end 112, illustrated in FIG. 27.

The dies used in the stamp and tab check operation (FIG. 26) include a lower die 113, and stamping die 114 movable in an upper clamping die 115, and a probe rod 116 also movalbe in die 115.

The assembled can end 95 of FIG. 25 is placed on die 113 and held in position by upper die 115. Stamping die 114 descends and stamps indicia such as a part number 117, a manufacturer number 118, and other information 119, perferably in the wall of the thumb indentation 92. At the same time, probe rod 116 descends and strikes the ring portion 120 of the pull ring tab 94 if the pull ring tab 94 is present and located in proper position. If the pull ring tab 94 is missing or improperly located, probe rod 116 will descend further and signal a missing or rotated tab.

IN GENERAL

The progressive operations described are designed to be carried out in the high speed production of the improved folded can ends. The successive operations, as indicated, control or prevent thinning of the blank in various areas or zones in one or more of the operations. Further, the preparation of the fold zone is started in the first blanking operation by the formation of the conically shaped annular band or fold panel. Successive metal working operations performed on the metal in this fold panel, including the prebulging steps, increase the diameter of the bulged portion successively, and reduce the height of the recess for the recessed wall 9, prepare the metal originating in the fold panel for folding, subject the metal to progressive prebulging and ultimately fold the metal to form the triple fold.

Along with the increase in the prebulged diameter, and the decrease in the recess depth, are the sharpening of the pivot point 47 around which the metal pivots during the folding operation; and the reduction in the radius of curvature of the curved corner 23–72 in successive operations to more sharply define the curved corner at the bottom of the recess in preparation for folding.

Another aspect of the interrelated character of the successive operations is the coining of various zones of the metal being cold worked, particularly where the scorelines subsequently are formed, whereby the scoring operations can be adequately controlled despite the thinness of the metal worked.

Another important aspect of the procedure is the formation of and location of the break point 49 at the inner periphery of the annular coined zone 45 and radially inward of the location of the pivot point 47 as well as radially inward of the outer surface of the prebulged portion 70 of the scored stage blank 59.

The described relationship and changes in dimensional characteristics of the prebulge, recess depth, pivot point and break point, as well as the related locations of coined areas and score lines, insure the ability to provide the triple fold 84 during the folding operation very close to the location of the rivet which secures a pull ring tab 94 to the can end, which tab 94 in turn ultimately is used to fracture a panel along the continuous score line 67 when it is desired to open a can in which improved folded can end has been seamed.

Another characteristics of the metal working operations described is the resultant fold clearance 87 in the segment of the fold adjacent that portion of the triple fold 84 overlapped by the nose 108 of the pull tab 94. This facilitates the initial bending of the upper layer of the triple fold 84 when rupture of the can end is initiated by pull tab 94 along the score line which is torn. At the same time, the end panel torn away initially bends on fold line score 59.

Another aspect of the new concept relates to the particular structure and arrangement of the three layer fold and its components. As stated in describing the procedure for manufacturing the can end, the resultant fold clearance 87 in the segment of the fold adjacent that portion of the fold overlapped by the nose 108 of the pull tab 94 facilitates initial bending of the upper layer of the triple fold when rupture of the can end is initiated by the pull tab 94. This clearance 87 spaces the upper layer of the fold in the fold segment, which may be a sector of about 100°, above the two lower fold layers, as shown in FIGS. 19, 21 and 24. The spacing or clearance 87 increases the thickness of the three layer fold in the 100° sector, as compared with the thickness of the fold in the remaining 260° sector thereof, as illustrated in FIG. 22.

The score line 67 (FIGS. 19, 21, 24) in the top surface of the upper layer of the three layer fold is located radially intermediate the location of the outwardly convex lower reverse bend 121 between the two lower layers of the three layer fold, and the inwardly convex upper reverse bend 122 having the fold clearance 87 between the top and middle layers of the three layer fold. Thus, when the panel portion is removed from the can end by severing along the score line 67, the torn outer edge of the upper fold layer is located inwardly of and does not project radially beyond the lower reverse bend 121 of the fold between the two bottom layers of the three layer fold.

FIG. 24 illustrates other important aspects of the new folded can end structure. The upper reverse bend 122 forms a downward offset in the can end recessed portion 9 which is bounded by the three layer fold. The lowermost fold layer extends inward toward the center of the can end flatwise, coplanar with the coined zone 55 in which the rivet 110–111 is formed, which connects the pull tab 105 to the can end. The fold line score 69 is formed in this flatwise extending portion intermediate the rivet and three layer fold. Thus, the can end is free of any stiffening offsets, corrugations or shoulders between the fold line score 69 and the three layer fold which if present would stiffen the can end metal and impede folding of the metal on the fold line 69 during initial rupture of the continuous score line 67 by the pull tab 105.

The pull tab 105 also has an offset 123 formed therein between the rivet and nose 108 corresponding to and spaced from the offset connected with the flatwise extending portion of the can end. The undersurfaces of the nose 108 of the pull tab 105 contacts the top surface of the top fold layer (FIG. 24) and extends to a location overlapping the continuous score line 67. This provides a position control for the extreme outer end of the nose 108 so that concave movement of the can end resulting from heat processing the contents of a container closed by the can end which may move the end of the pull tab nose 108 slightly to the right (FIG. 24) retains the location of the extreme end of the nose 108 intermediate the spread of the top opening in cross section of the score line 67 so that a shear force may be imparted to the score line 67 to initiate severing the can end on the score line by pull tab movement.

Accordingly, the present invention provides new procedures for the manufacture of folded can ends by a series of cold working, forming, drawing, etc., operations which are mutually related and interrelated to control metal thinning and to direct and control metal flow and reforming of very light gauge, preferably aluminum, sheet metal; provides a procedure which achieves the described objectives by successive and progressive metal working operations that can be carried out and controlled in high production facilities; provides an efficient procedure for the manufacture of the indicated desirable folded sheet metal can end structure; provides a procedure which accomplishes the many new functions described; provides a procedure including the described coordinated critical factors which have enabled the successful production of a folded can end structure having the described characteristics; provides a procedure which overcomes difficulties encountered in attempting to devise an efficient method of making the desired folded can end structure; provides a procedure which achieves the objectives and satisfies needs existing in the art; and provides the described new folded can end product.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description of the improvements is by way of example and the scope of the present invention is not limited to the exact details shown or described, or to the specific articles illustrated, since the invention may be applied to the manufacture of the various sizes and shapes of folded can ends.

Having now described the features, discoveries and principles of the invention, the operations and procedures of preferred method steps thereof, the construction and operation of new die arrangements and their coordinated design, the characteristics of the stage blanks produced, the new products produced, and the advantageous, new and useful results obtained thereby; the new and useful methods, steps, operations, procedures, products combinations, structures, arrangements, discoveries and principles are set forth in the appended claims.

I claim:

1. In a metal can end of a type which is adapted to be seamed to a can body, in which the can end has a seam flange and a recessed corner located below the seam flange, in which a recessed portion extends inward from the corner, in which an annular three layer fold extends continuously around the recessed portion adjacent said corner, in which there is an inwardly convex upper reverse bend between the top two layers of the three layer fold and an outwardly convex lower reverse bend beneath the upper layer and between the lower two layers of the three layer fold, in which there is a continuous score line in the top surface of the top fold layer located radially between the upper and lower reverse bends, and in which a pull tab has rivet connection with the recessed portion and has a nose located adjacent the score line; the improvement including a sector of the three layer fold extending on either side of a center line for the pull tab running through the pull tab rivet connection and nose having a thickness greater than the thickness of the remaining extent of the continuous three layer fold.

2. The construction defined in claim 1 in which the thicker sector extends about 50° on either side of the pull tab center line.

3. The construction defined in claim 1 in which there is clearance between the top layer and the lower two layers of the three layer fold in at least portions of the thicker sector of the three layer fold located beneath the pull tab nose.

4. The construction defined in claim 3 in which the clearance space extends in the three layer fold about 50° on either side of the pull tab center line.

5. The construction defined in claim 1 in which the zone of the upper layer of the three layer fold in which the continuous score line is located comprises coined work hardened metal.

6. The construction defined in claim 1 in which the uper reverse bend forms a downward offset in the recessed portion of the can end bounded by the three layer fold, in which the lowermost fold layer extends inward toward the center of the can end flatwise coplanar with the zone of the recessed portion in which the pull tab rivet cnnection is formed, and in which a fold line score is formed intermediate the rivet connection and three layer fold in the flatwise extending recessed portion, whereby the can end is free of stiffening offsets between the fold line score and three layer fold, and whereby folding of the flatwise extending recessed portion on the fold line score is facilitated during initial rupture of the continuous score line by the pull tab.

7. The construction defined in claim 6 in which the pull tab has an offset formed therein between the rivet connection and nose corresponding to and spaced from the downward offset in the recessed portion of the car end, and in which the pull tab nose has a portion flatwise contacting the top surface of the top fold layer and extending to a location adjacent the score line.

8. The construction defined in claim 7 in which the pull tab nose overlaps the score line.

9. The construction defined in claim 1 in which the pull tab nose contacts the top surface of the top fold layer and overlaps the score line, whereby the pull tab nose position is controlled to impart a shear force to the score line for initiating score line rupture despite concave movement of the can end recessed portion incident to heat processing of a can closed by the can end.

10. An easy opening container wall comprising:

a container wall of sheet material;

a line of weaknes in the container wall defining a tear portion at least partially removable therefrom;

first means attached to said tear portion for initiating rupture of the sheet material by an inwardly directed force and for tearing the sheet material generally along the line of weakness to at least partially remove the tear portion from the container wall, said tearing of sheet material providing a relatively sharp edge on the tear portion, the initiation of rupture of the sheet material occurring at a preselected region along the line of weakness;

second means on the tear portion and extending along a peripheral region thereof for protecting te user against injury from the sharp edge when the tear portion is at least partially removed from the container wall; and said second means being interrupted adjacent said preselected region of the line of weakness sufficiently to substantially prevent said second means from hindering the initiation of rupture of the sheet material in response to said inwardly directed force.

11. An easy opening container wall comprising:

a container wall of sheet material;

a line of weakness in the container wall defining a rupturable web, said rupturable web defining a tear portion at least partially removable therefrom;

means attached to said tear portion for initiating rupture of the rupturable web at a preselected region thereof by an inwardly directed force and for tearing the rupturable web to at least partially remove the tear portion from the container wall, said tearing of the sheet material providing a relatively sharp edge on the tear portion;

a guard on the inner side of said tear portion extending along the periphery of the tear portion to protect the user against injury from the sharp edge; and said guard being spaced inwardly in a generally axial direction from the rupturable web at least adjacent a portion of said preselected region to facilitate the initiation of rupture of the rupturable web at said preselected region by said inwardly directed force.

12. An easy opening container wall as defined in claim 11 wherein said guard includes multiple layers of sheet material of the tear portion.

13. An easy opening container wall as defined in claim 11 wherein said guard includes a guard bead.

14. An easy opening container wall comprising:

a container wall of sheet material;

a line of weakness in the container wall defining a tear portion at least partially removable therefrom;

means attached to said tear portion for tearing the sheet material generally along said line of weakness to at least partially remove the tear portion from the container wall, said means initiating rupture of the line of weakness by forcing a peripheral segment of the tear portion inwardly;

said tear portion including a panel section and a marginal region substantially circumscribing said panel section;

the marginal region of said tear portion having a cross sectional configuration which includes a first reverse bend section opening generally radially outwardly, a second reverse bend section joined to said panel section and opening generally radially inwardly, and a leg section joining said bend sections;

said second reverse bend section being in a radial position closely adjacent the line of weakness to shield the user against injury from the sharp edge; and said second reverse bend section and at least a portion of said leg section being spaced generally axially inwardly from at least a portion of said peripheral segment to allow said peripheral segment to be forced inwardly to initiate rupture of the line of weakness without substantial interference from the bend sections and said leg section.

15. An easy opening container wall as defined in claim 14 wherein said tearing of the sheet material provides a relatively sharp edge on the tear portion, said bend sections and said leg section at least partially define a protector for protecting the user against said sharp edge, and said initiation of rupture deforms said peripheral segment inwardly into substantial contact with said leg section whereby the protector can more efficiently protect the user agaist injury from the portion of said sharp edge of the peripheral segment.

16. The construction defined in claim 1 in which the upper reverse bend forms a downward offset in the recessed portion of the can end bounded by the three layer fold, in which the lowermost fold layer extends inward toward the center of the can end flatwise coplanar with the zone of the recessed portion in which the pull tab rivet connection is formed, in which means is provided in the recessed portion adjacent the rivet connection to facilitate folding of the can end intermediate the rivet connection and three layer fold in the flatwise extending recessed portion, in which the pull tab has an offset formed therein between the rivet connection and nose corresponding to and spaced from the downward offet in the recessed portion of the can end, and in which the pull tab nose has a portion flatwise contacting the top surface of the top fold layer and extending to a location adjacent the score line; whereby the can end is free of stiffening offsets between the facilitating means and three layer fold, and whereby folding of the flatwise extending recessed portion adjacent the three layer fold is facilitated during initial rupture of the continuous score line by the pull tab.

17. The construction defined in claim 16 in which the pull tab nose overlaps the score line.

18. The construction defined in claim 16 in which the pull tab nose contacts the top surface of the top fold layer and overlaps the score line, whereby the pull tab nose position is controlled to impart a shear force to the score line for initiating score line rupture despite a tendency of concave movement of the can end recessed portion incident to heat processing of a can closed by the can end.

* * * * *

UNITED STATES PATENT AND TRADEMARK OFFICE

CERTIFICATE OF CORRECTION

PATENT NO. : 4,116,361

DATED : September 26, 1978

INVENTOR(S) : Donald E. Stargell

It is certified that error appears in the above-identified patent and that said Letters Patent are hereby corrected as shown below:

Col. 8, line 16 - insert -close as- after "as" and before "possible"

Col. 8, line 26 - "in" should be -to-

Col. 9, line 42 - "prevent" should be -prevents-

Col. 11, line 26 - "thick" should be -this-

Col. 12, line 22 - "017" should be -107-

Col. 12, line 29 - "even" should be -event-

Col. 12, line 55 - "movalbe" should be -movable-

Col. 12, line 62 - "perferably" should be -preferably-

Col. 13, line 48 - "characteristics" should be -characteristic-

Col. 15, line 67 - "uper" should be -upper-

Col. 16, line 4 - "cnnection" should be -connection-

Col. 16, line 16 - "car" should be -can-

Col. 16, line 31 - "weaknes" should be -weakness-

UNITED STATES PATENT AND TRADEMARK OFFICE

CERTIFICATE OF CORRECTION

PATENT NO. : 4,116,361

DATED : September 26, 1978

INVENTOR(S) : Donald E. Stargell

It is certified that error appears in the above-identified patent and that said Letters Patent are hereby corrected as shown below:

Col. 16, line 43 - "te" should be -the-

Col. 18, line 9 - "agaist" should be -against-

Signed and Sealed this

*Twenty-third* Day of *January 1979*

[SEAL]

*Attest:*

RUTH C. MASON
*Attesting Officer*

DONALD W. BANNER
*Commissioner of Patents and Trademarks*